United States Patent [19]

Spiro

[11] 4,369,962

[45] Jan. 25, 1983

[54] APPARATUS FOR FEEDING SHEETS

[76] Inventor: Murray Spiro, 35-7 Fairfieldway, Commack, N.Y. 11725

[21] Appl. No.: 234,691

[22] Filed: Feb. 17, 1981

[51] Int. Cl.[3] ..... B65H 3/08

[52] U.S. Cl. ..... 271/11; 271/98; 271/100; 271/103; 271/107

[58] Field of Search ..... 271/100, 101, 102, 99, 271/93, 98, 105, 103, 11, 12, 13, 14, 5, 107; 414/128; 221/211, 238

[56] References Cited

U.S. PATENT DOCUMENTS

| | | | |
|---|---|---|---|
| 1,298,485 | 3/1919 | Feldman | 271/100 |
| 1,715,360 | 6/1929 | Harrold | 271/103 |
| 2,394,007 | 2/1946 | Paynter | 271/101 X |
| 2,524,417 | 10/1950 | Bamber | 271/99 X |
| 2,569,219 | 9/1951 | Bamber et al. | 271/99 X |
| 2,590,222 | 3/1952 | Van Veen | 271/102 X |
| 2,643,120 | 6/1953 | Jackson | 271/102 |
| 2,979,329 | 4/1961 | Cunningham | 271/98 |
| 3,155,386 | 11/1964 | Burleigh | 271/100 X |
| 3,181,860 | 5/1965 | Liebenow | 271/102 |
| 3,655,181 | 4/1972 | Paulson | 271/98 |
| 3,851,871 | 12/1974 | Aronson | 271/99 X |
| 3,893,664 | 7/1975 | Thomsen | 271/100 |
| 3,926,427 | 12/1975 | Moksnes et al. | 271/99 X |
| 3,934,868 | 1/1976 | Selak | 271/100 X |
| 4,060,228 | 11/1977 | Tress et al. | 271/100 X |
| 4,184,670 | 1/1980 | Rosendahl | 271/99 X |

*Primary Examiner*—Bruce H. Stoner, Jr.

[57] ABSTRACT

An apparatus for feeding a single sheet from the bottom of a stack of sheets to a station for performing subsequent operations on the sheet. The apparatus is comprised of a magazine to receive a stack of sheets having a bottom support and upstanding walls, the bottom support having an opening therein through which the lower most sheet can be removed. A suction nozzle is provided below the magazine opening and a vacuum surface is provided below the suction nozzle. A first pivot arm is attached to the suction nozzle and a second pivot arm is attached to the vacuum surface. A sheet receiving and feeding apparatus below the magazine receives and feeds the sheet to the station which performs the subsequent operation on the sheet. The pivot arm is pivoted to (i) raise the suction nozzle to engage the surface of the lower most sheet, and subsequently (ii) lower the suction nozzle to engage the bottom surface of the sheet with the vacuum surface. The second pivot arm is pivoted to (i) move the vacuum surface towards the receiving and feeding apparatus for receipt of the sheet, and (ii) return the vacuum surface to the position below the suction nozzle and magazine. A first and second vacuum are provided for, respectively, applying the vacuum to the suction nozzle and to the vacuum surface.

5 Claims, 5 Drawing Figures

APPARATUS FOR FEEDING SHEETS

BACKGROUND OF THE INVENTION

1. Field of the Invention

The present invention relates to an apparatus for feeding a single sheet from the bottom of a stack of sheets, one at a time. Such an apparatus finds practical use in connection with systems where a sheet of paper is to be fed to a station for performing subsequent operations on the sheet, such as placing the sheet in an envelope. Usually, the sheets which can be paper, cardboard, booklets, etc. are stacked in a magazine and the sheets are conveyed by various known apparatus to an envelope where they are inserted by machine. It is highly desirable to perform this conveyance and insertion of the sheet in the envelope as quickly and as safely as possible. The apparatus of this invention may also be used for feeding sheets for printing, wrapping and other type operations where it is highly desirable to rapidly and safely feed a single sheet from a stack of such sheets.

2. Prior Art

In the past apparatus have been devised for feeding sheets one at a time off the top or the bottom of a stack of sheets. As is well known, it is extremely difficult to devise such an apparatus which will unfailingly remove one sheet, and only one, at each movement.

In the top feeding apparatus, one or more vacuum cups are lowered down on the top sheet in the stack to grip the top sheet and lift it off the stack. The vacuum cups are moved upwardly and downwardly until the top sheet is clear of the stack and in a position for processing. The vacuum in the vacuum cup is then cut off to drop the separated sheet into the suitable sheet processing apparatus while the vacuum cups are then moved back to the stack of sheets. The top feeding apparatus has the disadvantage that fresh sheets of paper cannot be loaded on top of the stack while the feeding apparatus is in operation. Accordingly, the feeding mechanism must be stopped when loading is necessary.

The prior art bottom feeding apparatus circumvents the above noted disadvantage but introduces other disadvantages. In such a prior art bottom feeding apparatus a stack of paper sheets, for example, is supported in a hopper or magazine having an open bottom. Means are then provided for removing the sheets from the magazine and conveying the sheets to a receiving and feeding station which then feeds the sheets to another station for performing subsequent operations on the sheets, for example, placing them in envelopes. The disadvantages, generally, of such bottom feeding apparatus (as well as top feeding apparatus) are that they are relatively complicated and expensive. In addition, it is difficult to insure against withdrawal of more than one sheet at a time.

The known prior art is exemplified by the following U.S. Pat. Nos.:

2,524,417 to Bamber;
2,569,219 to Bamber et al.;
2,590,222 to Van Veen;
2,643,120 to Jackson;
3,181,860 to Liebenow et al.;
3,851,871 to Aronson;
3,926,427 to Moksnes et al.; and
4,184,670 to Rosendahl.

Bamber and Bamber et al. remove sheets from a bottomless holder or magazine having two fixed ledges. At least one suction nozzle is provided beneath the pile. The suction nozzle is first brought into contact with the lower most sheet and caused to grip the sheet by suction. The suction nozzle is then moved rearwardly with respect to the direction in which the envelope is to be fed so as to disengage the forward edge of the sheet from one of the ledges. The sheet is then lowered away from the bottom of the stack and then moved forwardly so as to detach the lowermost sheet from the stack and deliver it to a means for carrying away the sheet. Such a motion requires a complicated mechanism to move the suction nozzle backwards, down and then forward.

Van Veen is another example of a complicated apparatus. Van Veen describes two opposed hoppers which hold the sheet to be fed. Two sets of picker fingers are provided for each hopper. The set of picker fingers move into contact with the sheet at the lower of the hoppers. Suction is provided to cause a suction to the set of picker fingers so that they will draw the sheet in the respective hopper against the finger. The fingers are then swung away from the hopper while simultaneously the opposite set of fingers are swung toward its respective hopper. The paper is then stripped from the picker. The mechanism for stripping the paper from the picker requires a stripper plate which moves up and down and requires the paper to flow in a vertical position, as opposed to the normal flow in most unit of horizontal. The stripper plate requires a cam, frame, etc. and is complicated to operate.

Jackson is directed to a sucker arranged beneath a stack of sheets which moves in a vertical position in a complicated arrangement of members. Jackson is able to withdraw one sheet at a time by arranging the sucker so that part of the aperture projects beyond the edge of the pile of blank sheets. Such an arrangement requires the exact placement of the sucker and does not allow for shifting of the apparatus or sheets within the magazine.

Liebenow et al. employes a group of suction cups supported on a traverse bar which is moved in feed and return strokes by a complicated apparatus. The bar is rockable about its longitudinal axis. Each cup is supported in spaced relation from the bar by a flexible conduit which is resiliently yieldable so that the cup can tilt in any direction away from vertical to seat squarely against the engaged face of the blank page. The method by which the bar moves through feed and return strokes is complicated and includes a means to automatically move the bar which holds the suction cup through a continual cycle of horizontal and vertical reciprocation during the feed operation.

Aronson describes a bottom feed magazine for holding sheets but requires that the sheet feed member have imparted thereto a reverse movement of counter rotation which provides a small buckling of sheets held thereby. This buckling frees the lower most sheet from the next adjacent single sheet and insures feeding even at high speeds. Such an arrangement is fairly complicated when compared to applicant's herein described and claimed invention.

Moksnes et al. describes a row of vacuum cups affixed to the upper portion of belt on a shuttle. The vacuum cups are activated with a vacuum to grasp the corner of the lower most sheet of the stack. The shuttles are then reciprocated to the left. The vacuum cups get drawn downwardly around the end of the moving shuttle and then beneath the shuttles to deflect the end of the lower most sheet into a gap.

Rosendahl describes a sheet of paper being sucked out of a stack by rotating roller into feed roller.

Most, if not all of the aforementioned references describe an apparatus which is complicated in nature, expensive to construct and still does not insure the rapid feeding of one sheet at a time from the bottom of a feed magazine.

OBJECTS AND SUMMARY OF THE INVENTION

Accordingly, it is object of the present invention to provide a sheet feeding apparatus which can operate at high speeds on a wide variety of sheet materials.

Another object is to provide a sheet feeding apparatus in which the sheet is being fed under positive control for the major portion of its length.

A further object is to provide a positive separation of the lower most sheet from the next adjacent sheet at the start of each feed cycle so that more than one sheet is not fed at one time.

An additional object of the present invention is to prevent damage to the sheet being fed by reason of stresses set up in the sheet by the feed mechanism or apparatus.

Another object of the present invention is to provide a sheet feeding apparatus which lends itself to easy adjustment for different lengths and/or widths of material.

It is a further object of this invention to provide a sheet feeding apparatus in which the sheets are fed in a more simple and more efficient manner than the prior art sheet feeding apparatus.

Still a further object is to provide a sheet feeding apparatus which will operate with a mimimum of motion for the work accomplished.

Still a further object of the present invention is to provide a sheet feeding apparatus which takes a sheet of paper from its stack as fast as possible, one sheet at at a time, and feeds it to a receiving and feeding means for feeding to a station for performing subsequent operations thereon.

The foregoing objects as well as others are accomplished by the apparatus of this invention which is used for feeding a single sheet from the bottom of a stack of sheets. The apparatus comprises a magazine for receiving a stack of sheets, e.g. paper, cardboard, envelopes, booklets, etc. The magazine has a bottom support and upstanding walls. The bottom support is provided with an opening therein through which the lower most sheet can be removed. At least one suction nozzle is stationed below the magazine opening. Additionally there is at least one vacuum surface below the magazine and the suction nozzle. A first pivot arm is attached to the suction nozzle and a second pivot arm is attached to the vacuum surface. A sheet receiving and feeding means is adjacent and below the magazine for receiving and feeding the sheet to a station for performing subsequent operations on the sheet. A first activation means is provided for pivoting the first pivot arm to (i) raise the suction nozzle to engage the bottom surface of the lower most sheet, and subsequently, (ii) lower the suction nozzle to engage the bottom surface of the sheet with the vacuum surface. A second activation means is provided for pivoting the second pivot arm to (i) move the vacuum surface towards the receiving and feeding means for receipt of the sheet and (ii) return the vacuum surface to the position below the suction nozzle and magazine. A first and second vacuum means are provided for applying, respectively, a vacuum to the suction nozzle and to the vacuum surface.

Optionally, and preferably, the opening at the bottom of the magazine is along one edge of the stack of sheets and means is provided for blowing compressed air along a portion of this edge and the bottom of the stack of sheets to separate the edge of the lower most sheet from the stack.

It is also desirable that the suction nozzle instantly retract downward when it engages the sheet.

When the sheets are booklets, heavy cardboard stock or the like it is desirable that the apparatus further comprise a means for urging the sheet onto the vacuum surface when the suction nozzle is lowered to engage the bottom surface of the sheet with the vacuum surface.

BRIEF DESCRIPTION OF THE DRAWING

The present invention will be described in detail in connection with the accompanying drawings, where.

DETAILED DESCRIPTION OF THE INVENTION

Figure 1:
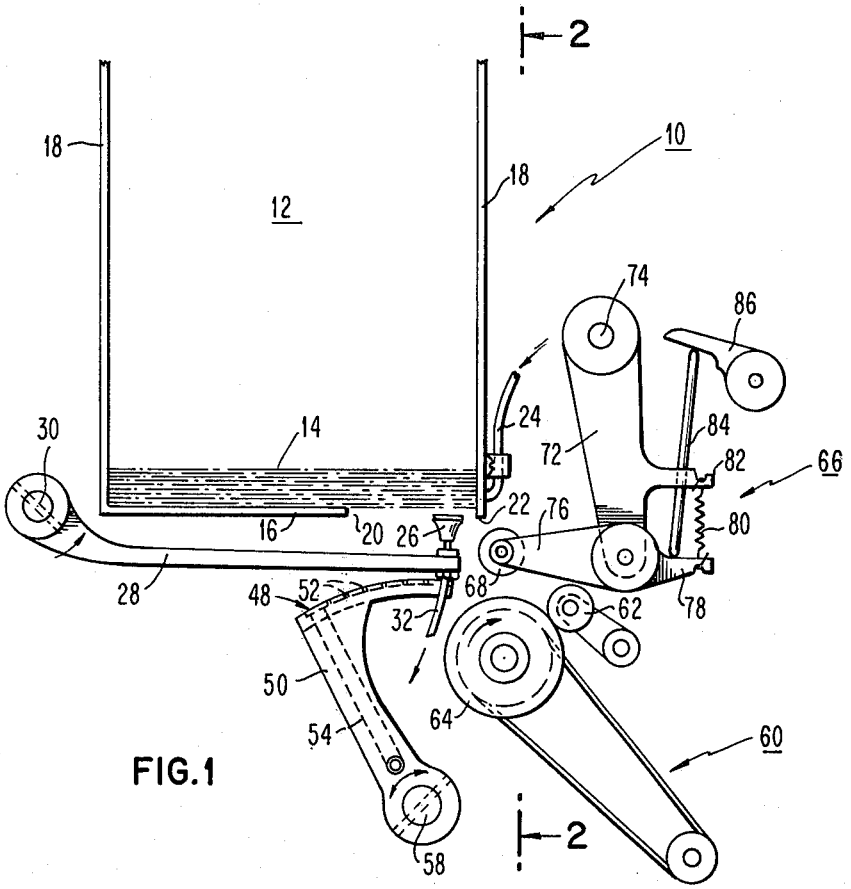
FIG. 1 is a side elevation of an embodiment of a device according to this invention just prior to contact of a sheet with the suction nozzle.

Referring to FIG. 1, a sheet feeding apparatus of this invention, generally designated (10) is comprised of a magazine, generally designated (12) to receive a stack of sheets (14). The sheets may have a shape which is different from the rectangular shape and the sheets may even consist of sheets which have been folded once, or sheets which have been folded numerous times so that several sheets which are placed on each other and linked together are obtained, e.g. a booklet, or sheets which are envelopes. The sheets can be made of any suitable material such as paper, plastic foil, aluminum foil, cardboard, etc.

As shown in FIG. 1, the magazine (12) is adapted to hold a stack of individual sheets (14). The magazine consists of a bottom support member (16) and upstanding walls (18) secured to the bottom support (16). The upstanding walls (18) and bottom support (16) may be made adjustable to accommodate sheets of different sizes (not shown). While the magazine (12) has been shown with the bottom support (16) at a horizontal disposition, it is within the purview of this invention to have the bottom support (16) on an incline. The bottom support (16) of the magazine (12) is provided with an opening or window (20) through which the lowermost sheet can be pulled. The magazine (12) may conveniently be opened at its upper end so that fresh sheets can be added to the stack (14) for the purpose of replenishing the stack when necessary by simply dropping the sheets on to the top of the stack.

Figure 2:
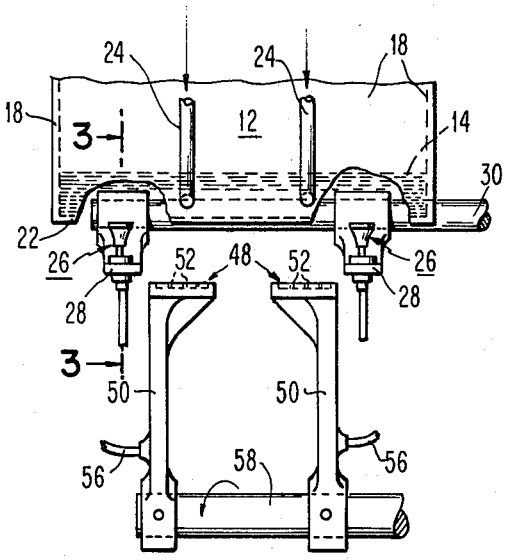
FIG. 2 is a partial section view of the device of FIG. 1 taken along line 2—2 of FIG. 1.

Preferably, the opening (20) runs along one edge (22) of the stack of sheets (14). Such a type opening (20) is particularly useful when a means is provided for blowing compressed air along a portion of this edge (22) and the bottom of the stack of sheets (14). As depicted in FIGS. 1 and 2 such a means comprises at least one air nozzle (24) and as depicted in FIGS. 1 and 2, preferably two air nozzles (24). These air nozzles (24) blow air between the lowermost sheet and the next adjacent sheet to provide a "fluffing" of the sheets near the bottom of the stack (14). Such a means assures that the suction nozzle (20)—discussed below—grips only one sheet. Such "fluffing" provides an air barrier between the lowermost sheet and the next adjacent sheet.

As indicated in FIGS. 1 and 2, the air nozzles (24) are attached to the upstanding wall (18) and blow air near the lowermost sheet. The nozzle may be adjustable along the width of the sheet (see FIG. 2) to assure that the lowermost sheet at the point of contact with the suction nozzle (26) is separated from the adjacent sheet. In general, this probably means that each suction nozzle (26) should have adjacent thereto attached to the upstanding wall (18) an air nozzle (24). This is depicted somewhat in FIG. 2. Such a configuration, however, is not necessary and the number and placement of the air nozzles (24) depends on the air nozzle configuration, air pressure used through the nozzle, placement of the nozzle, etc.

As depicted in FIG. 1, at least one suction nozzle (26) is provided below the magazine opening (20). The suction nozzle (26) is attached to a pivot air (28) which rotates about a pivot (30). As depicted, more clearly in FIG. 2 there are two suction nozzles (26) each being attached to a pivot arm (28). It is, however, contemplated that more than one suction nozzle may be attached to a pivot arm. As depicted in the Figures the suction nozzle (26) has attached to it tubing or hosing (32) connected to a means for applying vacuum to the suction nozzle (26).

Figure 3:
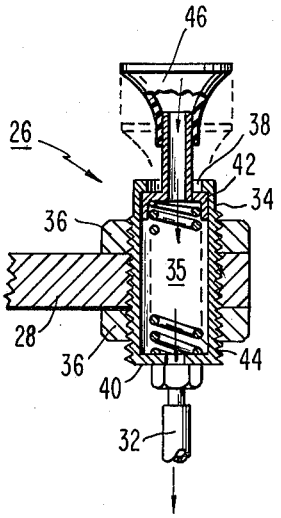
FIG. 3 is a sectional view of the suction nozzle used in the embodiment of the device depicted in FIGS. 1 and 2 taken along line 3—3 of FIG. 2.

Preferably, the suction nozzle (26) is of the type that when it engages the sheet it automatically retracts downward from the stack of sheets (14). Such an action provides for the immediate separation of the sheets from the stack (14) without awaiting the pivoting of the pivot arm (28). Such immediate retraction of the sheet from the stack (14) avoids any delay which may be present in pivoting arm (18) from the stack and allowing the suction nozzle (26) to remain in an engaging position with the stack (14) for too long a time causing the engagement of more than one sheet of paper on the suction nozzle (26). Such a retracting type suction nozzle is depicted in detail in FIG. 3. The nozzle, generally designated (26) comprises a hollow elongated member (34) which is screwably mounted to the end of the pivot arm (28). Such a mounting may be accomplished by providing the outer surface of the member (34) with thread and providing mating threads in a hole passing through the pivot arm (28). Nuts (36) are then mounted on each end of the member (34). The chamber (35) of member (34) has an open upper end (38) and a closed lower end (40). By the use of the term "open" it is meant that the chamber (35) within the member (34) is open to the atmosphere vis-a-vis exposed to a vacuum. A piston member (42) is slidably and sealingly mounted within the chamber (35). A spring retaining means, e.g. helical spring (44) is mounted below the piston member (42) and retains the piston member (42) at the upper end of the chamber. A sucker (46) is attached to the piston member (42). The center of the sucker (46) is in fluid communication with the chamber (35) below the piston member (42). A vacuum is applied through the tubing or hosing (32) to the chamber (35) below the piston member (42). Thus when the sheet engages the sucker (46) a vacuum forms in the chamber (35) below the piston member (42) causing the atmospheric pressure applied above the piston member (42) to drive the sucker (26) downward against helical spring (44). Thus upon the sucker (46) contacting the sheet it is immediately retracted from the stack (14) thus assuring gripping engagement of only one sheet from the stack (14).

In order to make the engagement between the sucker (46) and the sheet as close and effective as possible, the sucker is preferably and conventionally a rubber cup type where the edges of its aperture may be of a lasting material such as rubber. Such suckers as well known in the art.

In operation an activation means is provided for pivoting the pivot arm (28) to first raise the suction nozzle (26) to engage the bottom surface of the lowermost sheet, and then subsequently lower the suction nozzle (26) to engage the bottom surface of the sheet with a vacuum surface (48), discussed below.

Figure 4:
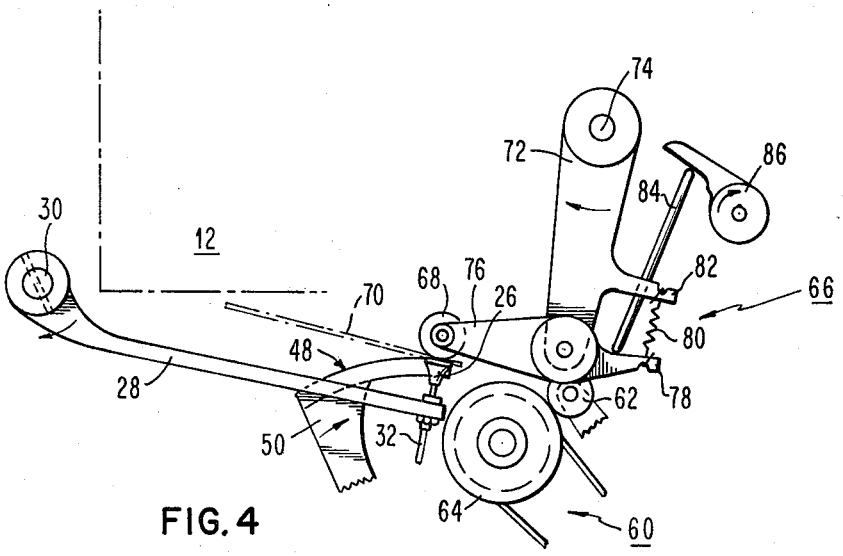
FIG. 4 is a side elevation schematic of the device of FIG. 1 just after contact of a sheet with the suction nozzle.
Figure 5:
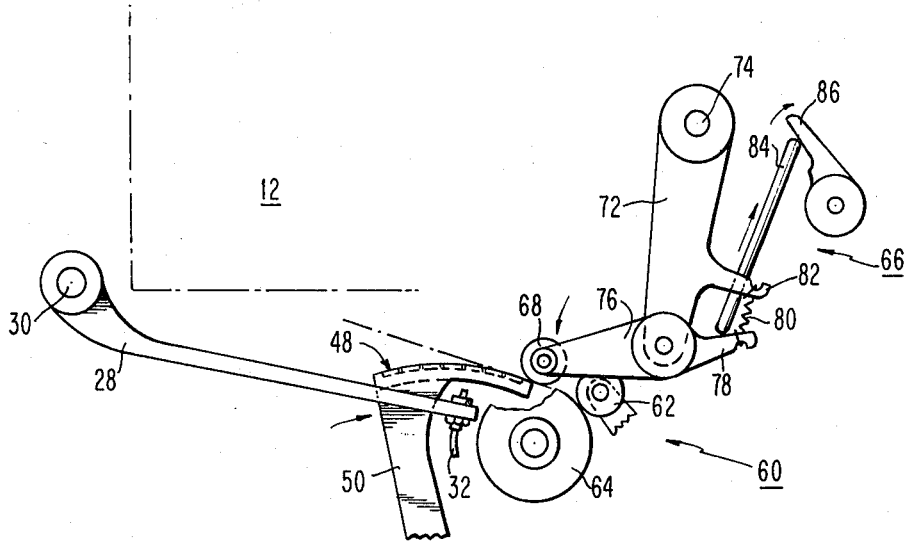
FIG. 5 is a side elevation schematic of the device of FIG. 1 just prior to release of the sheet from the suction nozzle.

Such an action is more clearly depicted in FIGS. 1, 4 and 5. FIG. 1 depicts the suction nozzle (26) just prior to contact with the lowermost sheet of stack (14). FIG. 4 depicts lowering the suction nozzle (26) by pivoting the pivot arm (28) downward. When the bottom surface of the lowermost sheet (70) contacts the vacuum surface (48) the suction nozzle (26) releases the vacuum on the sheet (70) permitting the vacuum surface (48) to provide for motion of the sheet (70) in the proper direction.

As indicated previously, at least one vacuum surface (48) is provided below the magazine (12) and the suction nozzle (26). The vacuum surface (48) is attached to a pivot arm (50). This is depicted more clearly in FIGS. 1 and 2. Preferably the vacuum surface (48) is curved surface having a curve equivalent to the curvature provided by a radius equivalent to the length of the pivot arm (50). The vacuum surface (48) additionally has a plurality of holes (52) connected to a plenum chamber (54) which leads to tubing or hosing (56) to apply vacuum to the surface (48). The plenum (54) as indicated in FIG. 1 may run through the pivot arm (50) and lead to the tubing or hosing (54). The pivot arm (50) rotates about pivot (58). As indicated in FIG. 2 a plurality of such vacuum surfaces (48) may be attached to pivot (58) through a pivot arm (50). Such vacuum surfaces (48), as well as the suction nozzles (46) may be adjusted along the length of the pivots (30 and 58) to provide optimum feeding.

Typically, as depicted in the FIGS. 1, 4 and 5 a sheet receiving and feeding means, generally designated (60) is adjacent and below the magazine (12) for feeding and receiving the sheets to a station for performing subsequent operations on the sheets, for example stuffing into envelopes, etc. As depicted in FIG. 1 the sheet receiving and feeding means (60) is comprised of a plurality of rollers (62 and 64) which are rotated in opposite directions.

An activation means is provided for pivoting pivot arm (50) to move the vacuum surface toward receiving and feeding means (60) after engagement of the vacuum surface (48) with the bottom surface of the lowermost sheet (70). The vacuum surface (48) feeds sheet (70) to the receiving and feeding means (60), and then returns to the position below the suction nozzle (26) and magazine (12) in ready receipt for engagement of another sheet with the vacuum surface (48).

It is highly desirable to have available for use to insure flexibility of use of the sheet feeding apparatus a means for urging certain type sheets on to the vacuum surface (48) when the suction nozzle (26) is lowered to engage the bottom surface of the sheet with the vacuum surface (48). Such an urging means is generally depicted as (66), in FIGS. 1, 4 and 5. Such an urging means (66) is generally not needed when ordinary sheets of paper are being used in the apparatus, however when heavy cardboard, booklets and/or "endfolded" sheets are being fed through the apparatus then such an urging means is highly desirable.

As shown in the Figures, the urging means, (66) is generally comprised of a roller (68) which engages the leading edge of the vacuum surface (48) just prior to the surface (48) moving toward the receiving end of the receiving and feeding means (60). This is more clearly depicted in FIG. 4 wherein the roller (68) has just engaged the leading edge of the vacuum surface (48) having a sheet (70) between the roller (68) and vacuum surface (48).

As depicted in FIGS. 1, 4 and 5, the urging means (66) is comprised of a pivot member (72) which is rotated about axis (74) which permits the urging means (66) to rotate with the vacuum surface (48) as it moves towards the receiving and feeding means (60). Pivotally attached to the other end of pivot member (72) is a secondary pivot arm (76) having attached to the far end roller (68). Attached to secondary pivot arm (76) is an extension member (78). The extension member is retained in the "urging" position, i.e. urging sheet (70) against vacuum surface (48), by a spring retaining means (80) which is attached to pivot member (72) through extension arm (82). Slidably mounted within extension arm (82) is slide member (84) which is activated by rotating lever (86) to raise roller (68) when not in use.

The apparatus of this invention operates in the following manner: sheets are loaded into the magazine (12). Air nozzles (24) separates the lowermost sheet from the stack (14). Suction nozzle (26) is raised to engage the lowermost sheet by rotating pivot arm (28) upwards towards the stack (14). Upon engagement of the bottom of the sheet, sucker (46) of the suction nozzle (26) immediately retracts into chamber (34) of the suction nozzle (26) and pivot arm (28) pivots downward. The bottom of the sheet engaged with the suction nozzle (26) then engages the vacuum surface (48). The vacuum on the suction nozzle (26) is then released. Vacuum surface (48) is then pivoted toward the sheet receiving and feeding means (60), i.e. rollers (62 and 64) by pivot arm (50). The rollers (62 and 64) then engage the sheet (70) and move it toward the next station.

If the urging means is required, upon release of the vacuum from suction nozzle (26) and engagement of sheet (70) upon vacuum surface (48), roller (68) engages sheet (70) urging it against vacuum surface (48) and into roller (62 and 64). Upon rollers (62 and 64) grasping sheet (70) slide member (84) is activated by rotating lever (86) downward to raise roller (68) away from sheet (70). Pivot member (72) is then rotated about axis (74) toward magazine (12) in position for the next sheet, and slide member (84) is raised by the urging of spring retaining means (80), permitting roller (68) to lower.

Obviously the rotation of the pivot arms, the release and activation of vacuum on the vacuum surfaces and suction nozzle and the rotation of rollers (62 and 64) are timed in such a manner to sequentially feed the sheets in a desired manner. Such means of timing and sequencing such activities are well known in the air and need not be described herein.

From the foregoing it will be seen that there has been provided a sheet feeding apparatus which fulfills all of the expressed objects of this invention as well as others.

Various changes and other modifications may be made without departing from the spirit of the invention all of such changes are contemplated as may come within the scope of the claims.

What is claimed is:

1. An apparatus for feeding a single sheet from the bottom of a stack of sheets comprising:

a magazine to receive a stack of sheets having a bottom support and upstanding walls, the bottom support being provided with an opening therein through which the lowermost sheet can be removed, wherein the opening is along one edge of the stack of sheets;

at least one suction nozzle below the magazine opening which retracts downward when engaging the sheet;

a means for blowing compressed air along a portion of the edge and bottom of the stack of sheets to separate the edge of the lowermost sheets from the stack prior to contact with the suction nozzle;

at least one curved vacuum surface below the magazine and the suction nozzle;

a first pivot arm attached to the suction nozzle;

a second pivot arm attached to the vacuum surface;

a sheet receiving and feeding means adjacent and below the magazine for receiving and feeding the sheet to a station for performing subsequent operations thereon;

a first activation means for pivoting the first pivot arm to (i) raise the suction nozzle to engage the bottom surface of the lowermost sheet and subsequently (ii) lowering the suction nozzle to engage the bottom surface of the sheet with the vacuum surface;

a second activation means for pivoting the second pivot arm to (i) move the vacuum surface towards the receiving and feeding means for receipt of the sheet, and (ii) return the vacuum surface to the position below the suction nozzle and magazine;

a first vacuum means for applying vacuum to the suction nozzle;

a second vacuum means for applying vacuum to the vacuum surface;

wherein the suction nozzle comprises:

a hollow elongated member having an open upper end and a closed lower end, the member being mounted near the end of the first pivot arm;

a piston member slidably and sealingly mounted within the chamber of the member;

a spring retaining means below the piston member for retaining the piston member at the upper end of the chamber;

a sucker attached to the piston member, the center of which is in fluid communication with the chamber below the piston member; and wherein the first vacuum means applies vacuum to the chamber below the piston member;

whereby when the sheet engages the sucker a vacuum forms in the chamber below the piston member causing the sucker to retract downward.

2. The apparatus of claim 1, wherein said means for blowing comprises at least one air nozzle.

3. The apparatus of claim 1, wherein the sheet receiving and feeding means comprises a plurality of rollers rotated in opposite directions.

4. The apparatus of claim 1, further comprising a means for urging the sheet onto the vacuum surface when the suction nozzle is lowered to engage the bottom surface of the sheet with the vacuum surface.

5. The apparatus of claim 4, wherein the means for urging comprises a roller which engages the leading edge of the vacuum surface just prior to it moving toward the receiving and feeding means.

* * * * *